US006487978B1

(12) United States Patent
Hamberg

(10) Patent No.: US 6,487,978 B1
(45) Date of Patent: Dec. 3, 2002

(54) SUPPORT SYSTEM

(75) Inventor: Scott L. Hamberg, Holland, MI (US)

(73) Assignee: Herman Miller Inc., Zeeland, MI (US)

( * ) Notice: Subject to any disclaimer, the term of this patent is extended or adjusted under 35 U.S.C. 154(b) by 0 days.

(21) Appl. No.: 09/610,922

(22) Filed: Jul. 6, 2000

(51) Int. Cl.[7] ..... A47B 9/00
(52) U.S. Cl. ..... 108/108; 108/106
(58) Field of Search ..... 108/108, 110, 108/107; 248/243, 239, 241; 211/187

(56) References Cited

U.S. PATENT DOCUMENTS

| | | | | |
|---|---|---|---|---|
| 3,511,193 A | | 5/1970 | Schild | |
| 4,013,254 A | | 3/1977 | Boundy et al. | |
| 4,146,140 A | | 3/1979 | Suter et al. | |
| 4,198,913 A | * | 4/1980 | Haworth et al. | 108/108 |
| 4,378,925 A | | 4/1983 | Griffin | |
| 4,535,704 A | | 8/1985 | Suttles | |
| 4,632,473 A | * | 12/1986 | Smith | 248/243 X |
| 4,716,841 A | | 1/1988 | Suttles | |
| 4,854,535 A | | 8/1989 | Winter et al. | |
| 5,318,264 A | * | 6/1994 | Meiste | 108/108 X |
| 5,351,740 A | * | 10/1994 | Hanna | 248/243 X |
| 5,538,213 A | * | 7/1996 | Brown | 108/108 X |
| 5,575,444 A | | 11/1996 | Otema | |
| 6,112,913 A | * | 9/2000 | Rindoks et al. | 108/108 X |
| 6,202,966 B1 | * | 3/2001 | MacDonald et al. | 248/243 |

* cited by examiner

*Primary Examiner*—Jose V. Chen
(74) *Attorney, Agent, or Firm*—Brinks Hofer Gilson & Lione

(57) ABSTRACT

A support system having a support member, a bracket and a work surface is disclosed. The support member has a slotted face and a support wall adjacent the slotted face. The bracket has a plurality of teeth adapted to engage the slotted face of the support member. The plurality of teeth include upper teeth and lower teeth. At least one of the lower teeth is sized to pass through the slotted face of the support member and engage the support wall. A work surface is supported by the bracket.

20 Claims, 3 Drawing Sheets

SUPPORT SYSTEM

FIELD OF THE INVENTION

The present invention relates to the field of support systems. In particular, the present invention relates to an improved bracket for supporting cantilevered components such as a shelf, work surface or cabinet.

BACKGROUND OF THE INVENTION

In recent years, the concept of open office planning which utilizes free standing partition systems for defining various office and workstation areas has become increasingly popular. Many of the manufacturers of these types of systems provide for the direct mounting of office accessories such as cabinets, shelves, work surfaces and the like to the free standing wall panel or partition. These systems can employ what is known as a slotted standard as a part of the wall panel or partition to serve as a mounting vehicle on that wall panel or partition. The slotted standard is generally a vertical steel channel which extends over at least a portion of a vertical dimension of a wall panel or partition and has therein a plurality of spaced or vertically aligned slots. The slots are adapted to receive a plurality of hook shaped connector elements which extend from the back surface of the accessory to the slotted standard. An example of a known hook shaped connector may be found in U.S. Pat. No. 3,877,191 entitled "CONNECTOR ASSEMBLY AND SUPPORT POST" issued to Robert J. Munzie.

Many users often place a heavy load on such work surfaces, shelves or cabinets. In particular, users can place items such as books and work accessories such as computers, monitors or printers thereon. However, when a heavy load is applied to many work surfaces or cabinets, it is possible for the hook shaped members to either deform the slotted standard or pull completely away therefrom.

Therefore, there is a need for an improved support system for a work surface, shelf or cabinet that can more readily accommodate a heavy load.

SUMMARY OF THE INVENTION

The present invention is directed to a support system for a worksurface, shelf or cabinet that can accommodate a heavy load. According to a first aspect of the invention, a support system having a support member, a bracket and a work surface are disclosed. The support member has a slotted face and a support wall adjacent the slotted face. The bracket has a plurality of teeth adapted to engage the slotted face of the support member. The plurality of teeth include upper teeth and lower teeth. At least one of the lower teeth is sized to pass through the slotted face of the support member and engage the support wall. A work surface is supported by the bracket.

According to another aspect of the invention, a support system having a support member and at least one bracket and a work surface are provided. The support member has an integrally formed first slotted face and a first support wall adjacent the slotted face. The bracket has a plurality of teeth adapted to engage the slotted face of the support member. The plurality of teeth include upper teeth and lower teeth. At least one of the lower teeth is sized substantially larger than the remaining lower teeth so as to pass through the slotted face of the support member and engage the support wall. The work surface is supported by the bracket with the substantially larger tooth providing additional support for the shelf by pressing against the support wall.

As used herein, the term "work element" is intended to included surfaces such as those found in shelves, cabinets and work surfaces, i.e., desk tops.

The present invention is directed to a support system that may more readily accommodate a heavy load. These and other advantages of the invention will be best understood in view of the attached drawings and the following detailed description.

DETAILED DESCRIPTION OF THE PRESENTLY PREFERRED EMBODIMENTS

Figure 1:
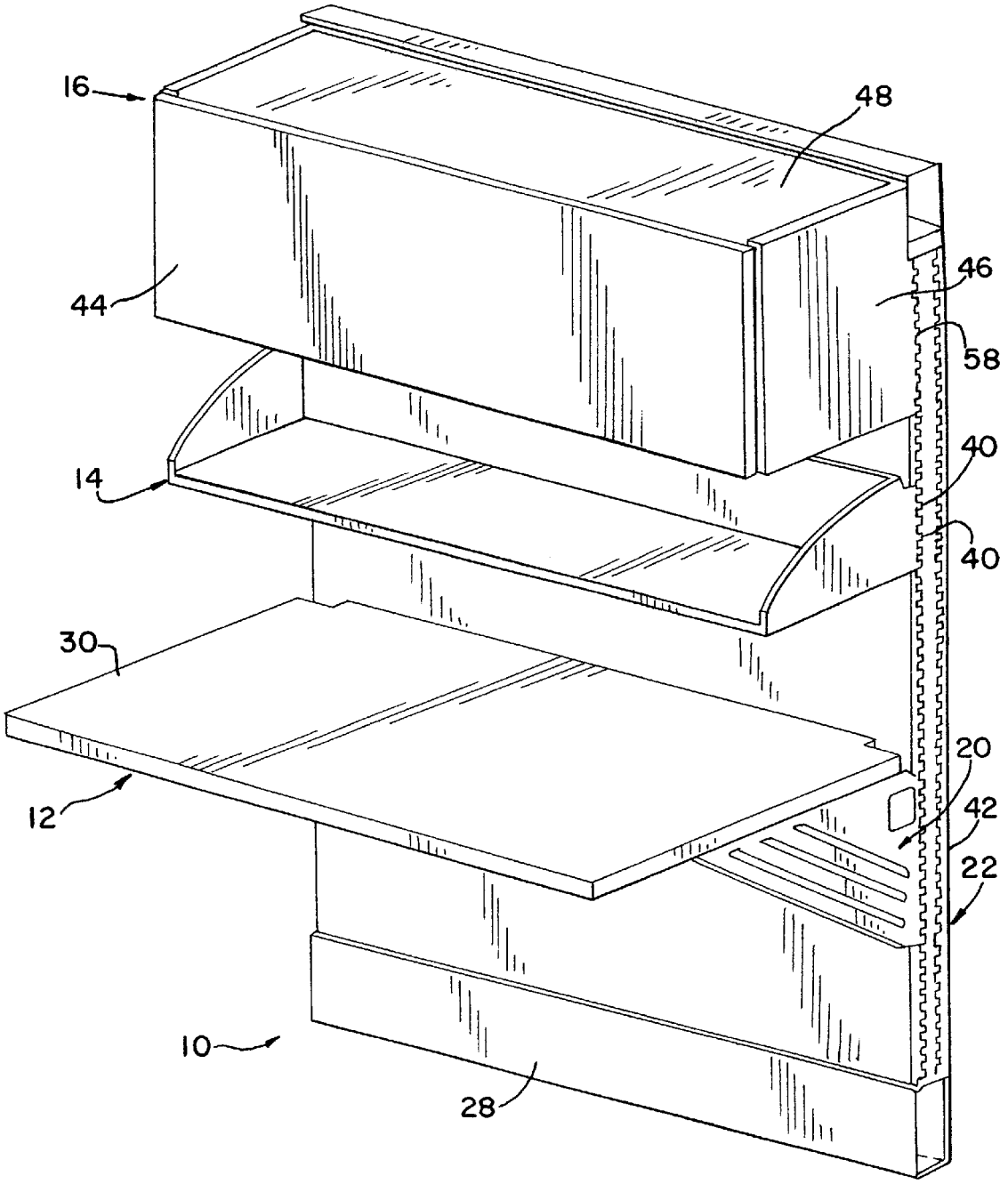
FIG. 1 is a perspective view of a support system constructed in accordance with an embodiment of the present invention.

FIG. 1 illustrates a wall panel or partition 10 that forms a portion of a work space management system. While the present invention is illustrated in the context of a freestanding work space management system, the present invention may also be used with fixed walls. The partition 10 includes a desktop or worksurface 12, a shelf 14 and a storage member 16 attached thereto. A bracket 20 interconnects and supports the worksurface 12 to partition 10. More specifically, the bracket 20 is connected to the support member or slotted standard 22. The partition 10 also includes a base cover 28. The worksurface 12 includes a planar top surface 30. The worksurface 12 may be formed from conventional materials known to those of ordinary skill in the art such as wood, fiberboard and wood components such as particle board, resins or steel. In addition, the worksurface 12 may have a powder coating or laminate applied thereto. The shelf 14 is spaced above the worksurface 12 and is also attached to the slotted standard 22. The shelf 14 includes a plurality of teeth 40 that engage slots 42 within the slotted standard 22 in order to secure the shelf 14 thereto. The storage member 16 includes a door 44, side walls 46, a top wall 48 and a bottom wall (not shown). The side walls 46 include teeth 58 that engage the slotted standard 22 as does the shelf 14 in order to secure the storage member 16 to slotted standard 22. The storage member 16 may be formed from conventional materials such as wood, wood components, resins or steel.

Figure 2:
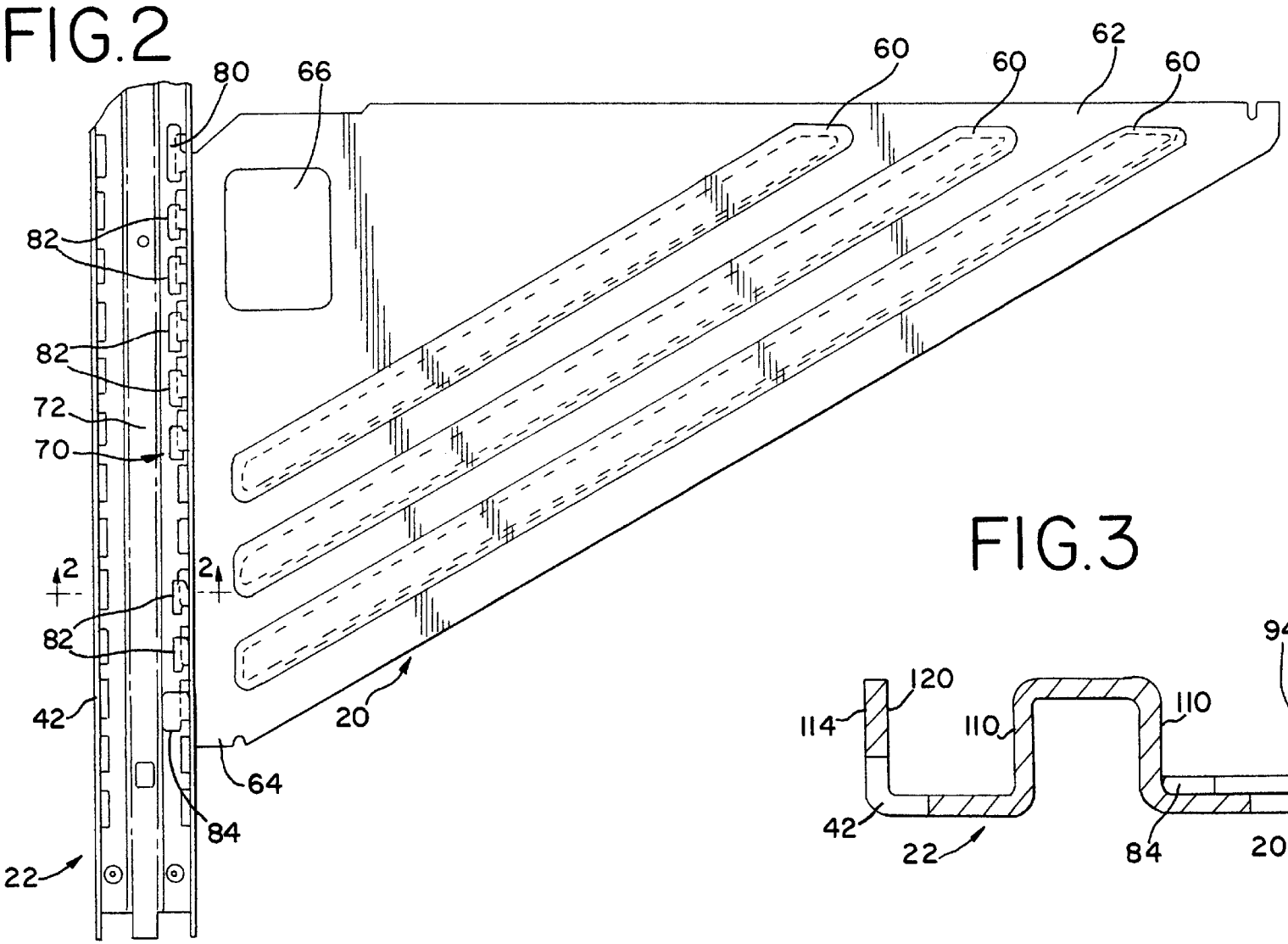
FIG. 2 is a side view of an embodiment of a support member and bracket a shown in FIG. 1.
Figure 3:
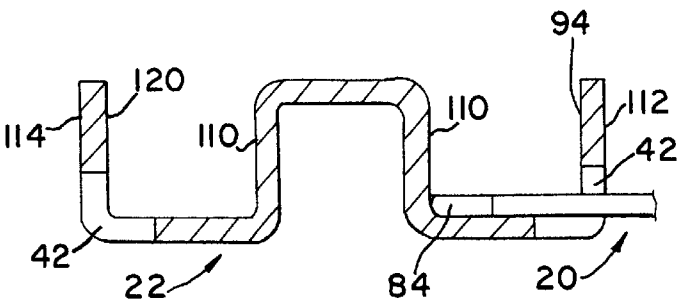
FIG. 3 is a sectional view of an embodiment of a support member and bracket taken along the lines 2—2 of FIG. 1.
Figures 4, 5:
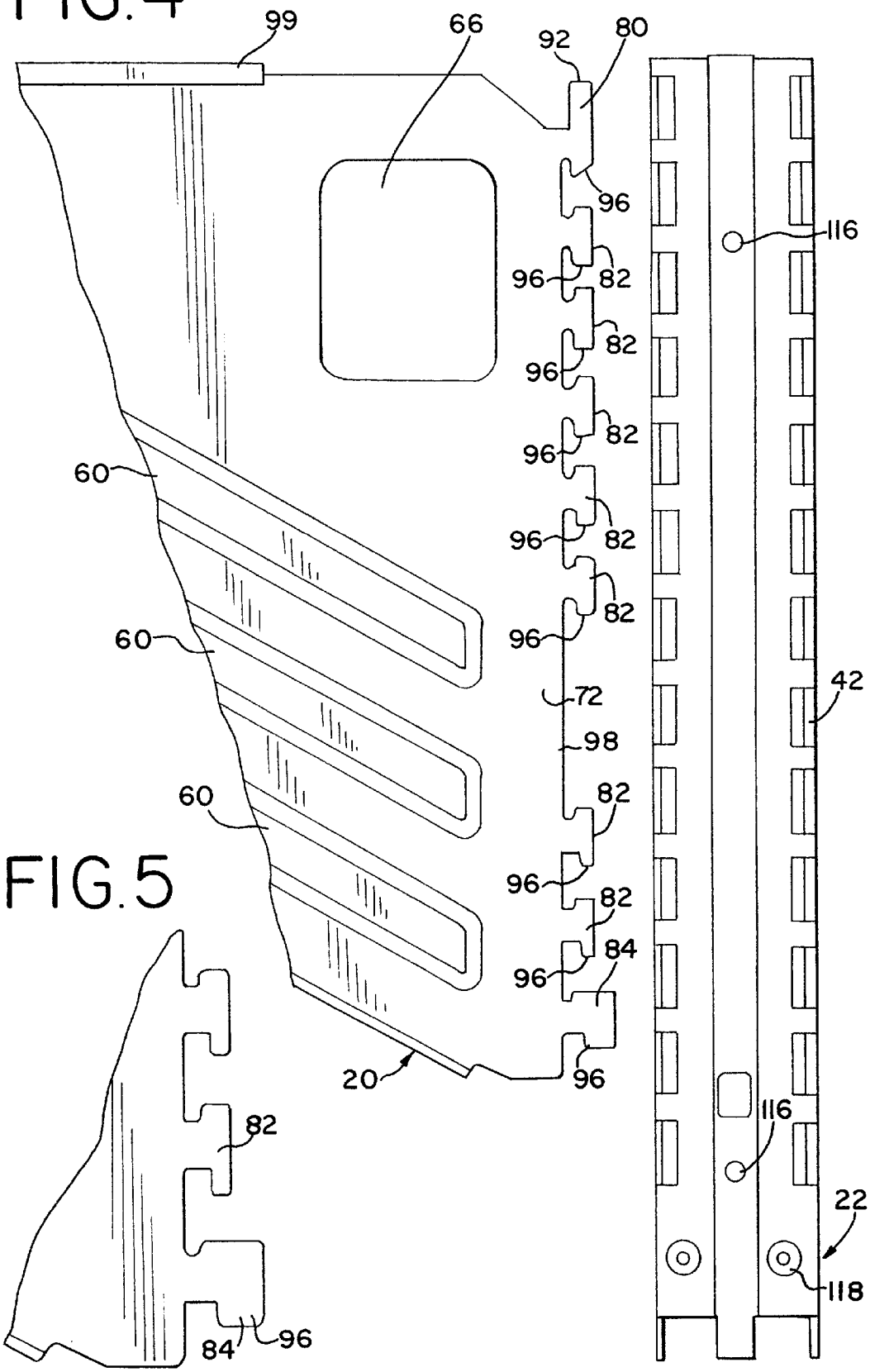
FIG. 4 is an exploded view of an embodiment of the support member and bracket as shown in FIGS. 1–3.
FIG. 5 is partially broken away view of a lower portion of the bracket according to the embodiment shown in FIGS. 1–4.

FIGS. 2–5 illustrate an embodiment of the bracket 20. The bracket 20 includes a plurality of ribs 60 extending angularly downward from a top portion 62 of the bracket 20 to a lower portion of the bracket 64. The aperture 66 provides an opening for elements such as wires or cables to pass therethrough. A plurality of teeth 70 extend from the rear 72 of the bracket 20. The teeth 72 include a top tooth 80, intermediate teeth 82 and a bottom tooth 84. The teeth 72 pass through slots 42 within the slotted standard 22. As best seen in FIG. 4, the top tooth 80 includes an elongated projecting portion 92 that extends upward. The projecting portion 92 engages the rear surface 94 of the slotted standard 22. The projecting portion 92 helps prevent the bracket 20 from being dislodged from slotted standard 22 upon accidental upward movement. The top tooth 80, intermediate teeth 82, and bottom tooth 84 include downwardly directed hook shaped projecting portions 96 that also engage the rear wall 94 of the slotted standard 22. A gap 98 is located between the intermediate teeth 82. The bottom tooth 84 is an enlarged tooth substantially larger than the top tooth 80 and the intermediate teeth 82. The bottom tooth 84 has a generally rectangular shape that extends out substantially farther than the top tooth 80 or the intermediate teeth 82. A flange 99 is connected to the worksurface 12 using conventional fastening elements such as screws.

The slotted standard 22, or support member, is best illustrated in FIGS. 2-4. The slotted standard 22 includes a rear wall 110, or support wall, and a first face 112 and a second face 114 in the illustrated embodiment. The rear wall 110 is parallel with the first and second faces 112, 114. The first face 112 and the second face 114 include the slots 42 through which the teeth 70 project. The hook-shaped projecting portions 96 of the teeth engage the rear surfaces 94, 120 of the slotted standard 22. Openings 116–118 are used to provide for attaching the slotted standard 22 to the panel core.

FIGS. 2 and 3 best illustrate the attachment of the teeth 70 to the slotted standard 22. With reference to FIG. 3, the connection of the bottom tooth 84 to the slotted standard 22 is illustrated. The bottom tooth 84 is sized to rest against the rear wall of the slotted support member 22. As a result, the rear wall 110 provides support for bracket 20 and helps prevent the accidental dislodgement of the bracket 20 from the slotted standard such as by being torn from the slotted standard 22.

Variations and modifications of the embodiments disclosed in this specification may be made without departing from scope and spirit of the invention. For example, the present invention may be implemented with fixed walls. In addition, the present invention may used with a slotted standard that includes only a single face thereof. The aforementioned description is intended to be illustrative rather than limiting and it is understood that the scope of the invention is set forth by the following claims.

I claim:

1. A support system comprising:

a support member having a slotted face with a rear surface and a support wall adjacent the slotted face;

a bracket having a plurality of teeth adapted to engage the slotted face of the support member, the plurality of teeth including upper teeth and lower teeth, the upper teeth being sized to pass through the slotted face of the support member and engage the rear surface of the slotted face without engaging the support wall, at least one of the lower teeth being enlarged compared to the upper teeth and sized to pass through the slotted face of the support member and engage the support wall; and a work element supported by the bracket.

2. The support system of claim 1 wherein the lower tooth that is sized to pass through the support member and engage the support wall is a bottom tooth.

3. The support system of claim 2 wherein the bottom tooth has a generally rectangular shape.

4. The support system of claim 3 wherein the support wall extends parallel with the slotted face.

5. The support system of claim 4 wherein the bracket includes a plurality of ribs extending substantially from the work element to the support member.

6. A support system comprising:

a support member having an integrally formed first slotted face with a rear surface and a first support wall adjacent the slotted face;

at least one bracket having a plurality of teeth adapted to engage the slotted face of the support member, the plurality of teeth including upper teeth and lower teeth, the upper teeth being sized to pass through the first slotted face of the support member and engage the rear surface of the first slotted face without engaging the first support wall, at least one of the lower teeth being sized substantially larger than the remaining lower teeth so as to pass through the slotted face of the support member and engage the support wall; and a work surface supported by the bracket wherein the substantially larger tooth provides additional support for the shelf by pressing against the support wall.

7. The support system of claim 6 wherein the lower tooth sized to pass through the support member and engage the support wall is a bottom tooth.

8. The support system of claim 7 wherein the bottom tooth has a generally rectangular shape.

9. The support system of claim 8 wherein the support wall extends parallel with the slotted face.

10. The support system of claim 9 wherein the support member includes a second slotted face opposite the first slotted face and a second support wall opposite the first support wall.

11. The support system of claim 10 wherein the work surface is a shelf.

12. The support system of claim 11 further comprising a second bracket having a plurality of teeth adapted to engage a slotted face of a second support member having a second support wall, the plurality of teeth including upper teeth and lower teeth, at least one of the lower teeth being sized substantially larger than the remaining lower teeth so as to pass through the slotted face of the second support member and engage the second support member.

13. The support system of claim 10 wherein the first and second brackets include opposing flanges that are connected to the shelf.

14. The support system of claim 13 wherein the bracket is formed from steel.

15. A support system comprising:

a first support member and a second support member, each support member having an integrally formed slotted face with a rear surface and a support wall adjacent the slotted face;

a first and second bracket, each bracket having a plurality of teeth adapted to engage the slotted face of the support member, the plurality of teeth including upper teeth and lower teeth, the upper teeth being sized to pass through the slotted face of the support member and engage the rear surface of the slotted face without engaging the support wall, at least one of the lower teeth being sized substantially larger than the remaining lower teeth so as to pass through the slotted face of the support member and engage the support wall; and a work element supported by the bracket wherein the substantially larger tooth provides additional support for the work surface by pressing against the support wall.

16. The support system of claim 15 wherein wherein the work element is a work surface.

17. The support system of claim 15 wherein the first and second brackets include opposing flanges that are connected to the work surface.

18. The support system of claim 15 wherein the tooth being sized substantially larger than the remaining lower teeth is the bottom tooth.

19. The support system of claim 15 wherein the support members are formed from steel.

20. The support system of claim 19 wherein the brackets includes an opening sized to accommodate a wire.

* * * * *